US009976824B2

(12) United States Patent
Borlaug

(10) Patent No.: US 9,976,824 B2
(45) Date of Patent: May 22, 2018

(54) RIFLE LOADING DEVICE

(71) Applicant: Kurt Borlaug, Forest Lake, MN (US)

(72) Inventor: Kurt Borlaug, Forest Lake, MN (US)

( * ) Notice: Subject to any disclaimer, the term of this patent is extended or adjusted under 35 U.S.C. 154(b) by 0 days. days.

(21) Appl. No.: 15/202,340

(22) Filed: Jul. 5, 2016

(65) Prior Publication Data

US 2017/0082386 A1 Mar. 23, 2017

Related U.S. Application Data

(60) Provisional application No. 62/189,005, filed on Jul. 6, 2015.

(51) Int. Cl.
*F41C 27/00* (2006.01)
*F41A 9/52* (2006.01)
*F41A 9/24* (2006.01)

(52) U.S. Cl.
CPC . *F41A 9/52* (2013.01); *F41A 9/24* (2013.01)

(58) Field of Classification Search
CPC ..... F41A 9/52; F41A 9/24; F41A 9/71
USPC ..... 89/128; 42/49.02
See application file for complete search history.

(56) References Cited

U.S. PATENT DOCUMENTS 6,212,814 B1 * 4/2001 Lambie ..... F41A 11/02 42/75.03
7,753,679 B1 * 7/2010 Schuetz ..... F41A 33/00 42/49.02
8,327,749 B2 * 12/2012 Underwood ..... F41A 9/59 42/18
8,387,296 B2 * 3/2013 Overstreet ..... F41A 9/70 42/50
8,898,946 B1 * 12/2014 Johnson ..... F41A 9/71 42/49.02
2005/0115128 A1 6/2005 Hahin
2010/0281736 A1 * 11/2010 Mayberry ..... F41A 21/481 42/49.01
2011/0056107 A1 * 3/2011 Underwood ..... F41A 9/59 42/18
2011/0247482 A1 * 10/2011 Overstreet ..... F41A 9/70 89/138
2015/0300766 A1 * 10/2015 Sims ..... F41A 33/00 434/16
2016/0258697 A1 * 9/2016 Hoon ..... F41A 17/38
2016/0327354 A1 * 11/2016 Dichario ..... F41A 9/70
2016/0348991 A1 * 12/2016 Tisone ..... F41A 9/59
2017/0045324 A1 * 2/2017 Zeman ..... F41A 17/36
2017/0138685 A1 * 5/2017 Beasley ..... F41A 9/71

FOREIGN PATENT DOCUMENTS

WO 2013017907 2/2013

* cited by examiner

*Primary Examiner* — Samir Abdosh
(74) *Attorney, Agent, or Firm* — Merchant & Gould P.C.

(57) ABSTRACT

An ammunition loading device for a firearm includes a body that is configured to be positioned within a magazine well of the firearm. The body has a cradle at a top surface for holding a single round of ammunition. The ammunition loading device further includes a bolt catch lifter positioned near the top surface of the body. The bolt catch lifter is configured to raise and lower a bolt catch mechanism of the firearm.

2 Claims, 4 Drawing Sheets

RIFLE LOADING DEVICE

BACKGROUND OF THE INVENTION

Field of the Invention

The present invention relates to a firearm loading device for selectively loading a single round of ammunition.

Description of the Prior Art

Firearms are configured to fire rounds of ammunition. To fire a firearm, the shooter of the firearm pulls a trigger mechanism, which releases a hammer. The hammer is designed to then strike a firing pin which, in turn, strikes an impact sensitive round of ammunition. Once struck, the round of ammunition expels a bullet from the barrel of the firearm toward a target.

Automatic or semi-automatic firearms allow the shooter to fire consecutive rounds of ammunition, without reloading, from a magazine. Examples of such firearms include the AR-15, the AR-10, and similarly styled variants. These rifles include a bolt that cycles backward and forward between each shot. When moving forward, the bolt pushes a round of ammunition from the top of the magazine into the firing chamber. Then, as the bolt moves backward after firing, an extractor removes the spent casing of the fired round from the firing chamber. This process can be repeated until all rounds have been fired from the magazine. After all rounds are fired from the magazine, many rifles include a bolt catch mechanism that is activated by the empty magazine. The bolt catch mechanism is configured to lock the bolt to the rear of the rifle to allow for the loading of a new magazine. Once the new magazine is loaded, the bolt catch mechanism can be lowered by pressing a bolt catch release button on the firearm, thus allowing the bolt to travel forward and chamber a round from the magazine.

While firing consecutive rounds is useful in certain types of shooting scenarios, for certain types of shooting competitions, competition rules dictate that the firearm only have a single round of ammunition loaded in the firearm at a time. Loading a magazine with a single round, firing the round, ejecting the magazine for the loading of another round, and then reinserting the magazine to the firearm is a cumbersome process. Alternatively, modifying magazines to allow for the loading of ammunition through an ejection port on the side of the firearm can be a risky activity as such modifications can lead to catastrophic failure, potentially injuring the shooter. Cumbersome loading and reloading can interrupt a shooter's rhythm, making the shooter less effective. Additionally, operating the bolt release button is also often an awkward reach for the shooter, further interrupting their shooting rhythm.

Therefore, improvements in ammunition loading devices are desired. The present disclosure addresses the problems associated with selectively loading a single round of ammunition.

SUMMARY OF THE INVENTION

In one aspect of the present disclosure, an ammunition loading device for a firearm is disclosed. The ammunition loading device includes a body that is configured to be positioned within a magazine well of the firearm. The body has a cradle at a top surface for holding a single round of ammunition. The ammunition loading device further includes a bolt catch lifter positioned near the top surface of the body. The bolt catch lifter is configured to raise and lower a bolt catch mechanism of the firearm.

In another aspect of the present disclosure, an ammunition loading device for a firearm is disclosed. The ammunition loading device includes a first body portion configured to be positioned within a magazine well of the firearm. The ammunition loading device also includes a second body portion that is pivotable about the first portion. Further, the ammunition loading device includes a linkage disposed between the first body portion and the second body portion. The linkage includes a bolt catch lifter that is movable between a raised position and a lowered position. When in the raised position, the bolt catch lifter holds a bolt catch of the firearm in a raised position. When moving from the raised position to the lowered position, the bolt catch lifter lowers the bolt catch of the firearm to a lowered position.

These features of novelty and various other advantages that characterize the invention are pointed out with particularity in the claims annexed hereto and forming a part hereof. However, for a better understanding of the invention, its advantages, and the objects obtained by its use, reference should be made to the drawings that form a further part hereof, and to the accompanying descriptive matter, in which there is illustrated and described a preferred embodiment of the invention.

BRIEF DESCRIPTION OF THE DRAWINGS

The following drawings are illustrative of particular embodiments of the present disclosure and therefore do not limit the scope of the present disclosure. The drawings are not to scale and are intended for use in conjunction with the explanations in the following detailed description. Embodiments of the present disclosure will hereinafter be described in conjunction with the appended drawings, wherein like numerals denote like elements.

DETAILED DESCRIPTION

Figure 1:
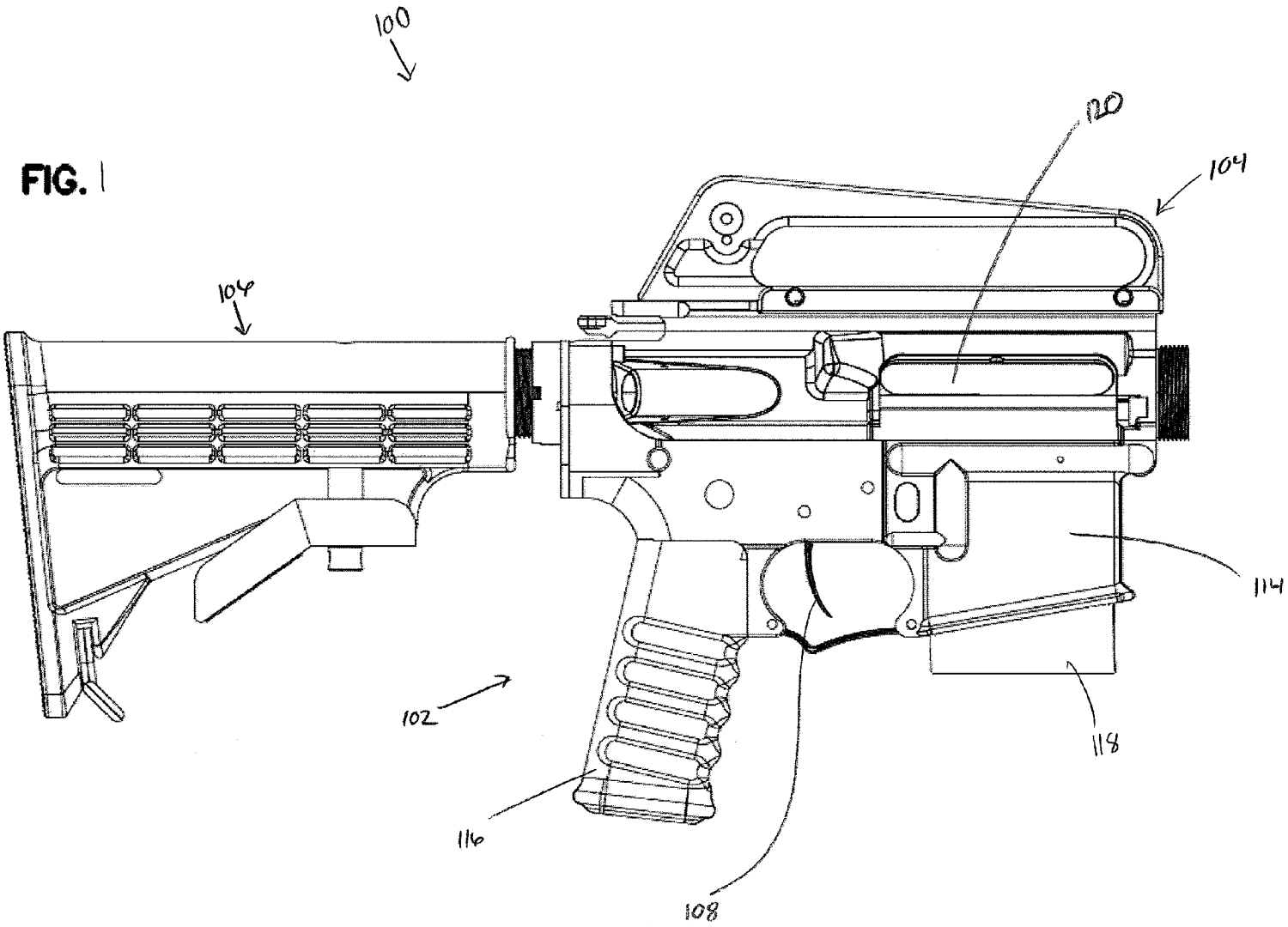
FIG. 1 illustrates a schematic right side view of an example firearm, according to one embodiment of the present disclosure.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

Figure 2:
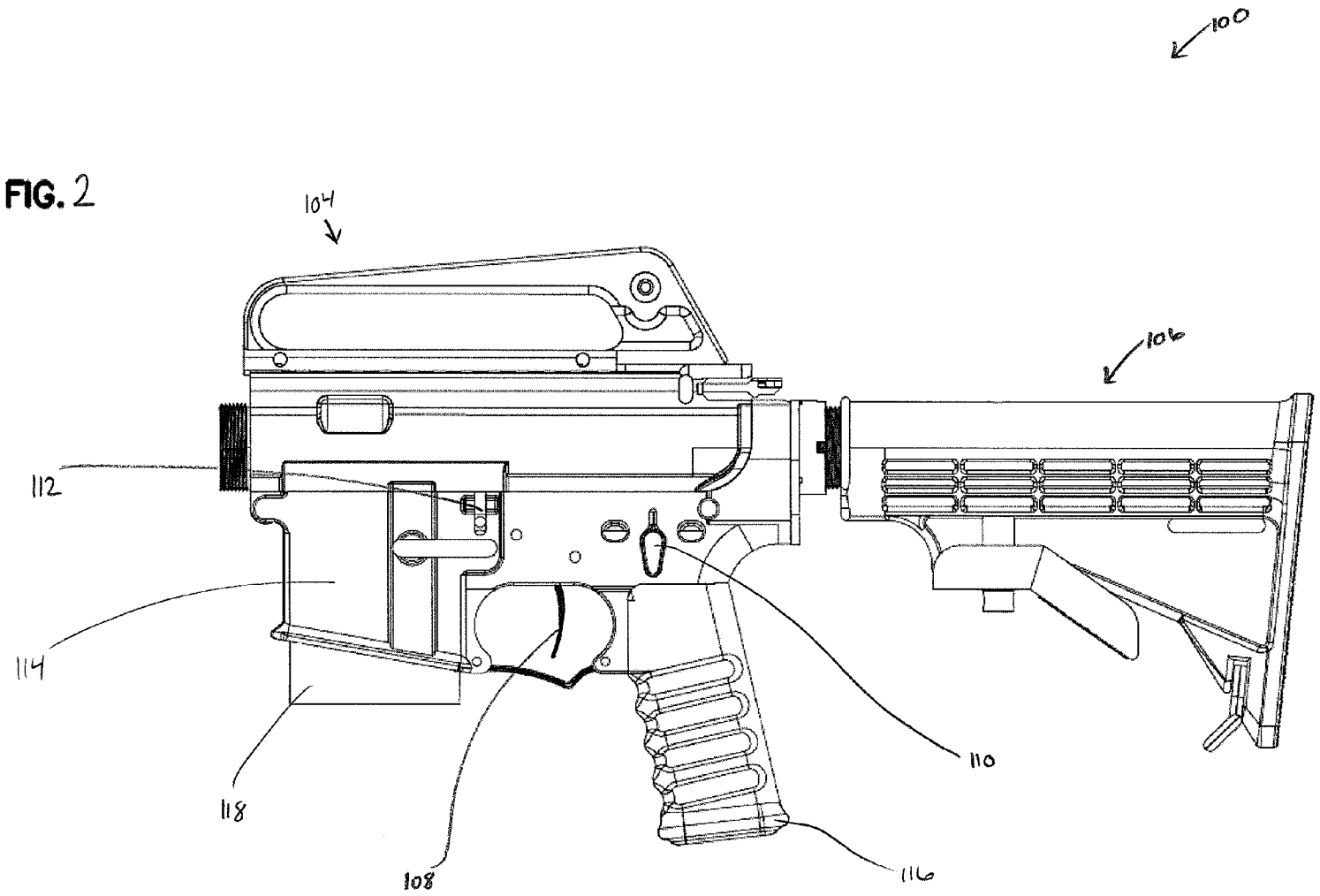
FIG. 2 illustrates a schematic left side view of the example firearm of FIG. 1.

FIGS. 1 and 2 are schematic right and left side views of an example firearm 100, respectively. In the example shown, the firearm 100 includes a lower receiver 102, an upper receiver 104, and a stock 106. Further, the example firearm 100 is shown without a barrel for illustrative purposes; however, the firearm 100 can include a variety of different barrels attached to the upper receiver 104. The firearm 100 shown is a rifle and can be an AR-15, an AR-10, or similarly styled variants.

The lower receiver 102 and upper receiver 104 are configured to house a firing mechanism and associated components as found in, for example, semi-automatic rifles and their variants. Specifically, the lower receiver 102 includes a trigger mechanism 108, a safety mechanism 110, a bolt catch release mechanism 112, and a magazine well 114. In some embodiments, the lower receiver 102 may also include a grip 116 and, in some embodiments, an ammunition loading device 118. The upper receiver 104 includes a bolt assembly (not shown) that is slidably disposed within the upper receiver 104 for axially reciprocating recoil movement therein during the firing cycle sequence of the firearm 100. Additionally, the upper receiver 104 also includes an ejection port 120 on the right side of the firearm 100 that is configured to allow spent ammunition to be ejected from the firearm 100. The ejection port 120 also allows unfired ammunition to be loaded into the firearm 100.

The trigger mechanism 108 is configured to be pulled by the finger of the shooter (e.g., the index finger) to initiate the firing cycle sequence of the firearm 100. The trigger mechanism 108 is mounted to the lower receiver 102 and is configured to discharge the firearm 100 when a predetermined amount of force is applied to the trigger mechanism 108.

The safety mechanism 110 is configured to facilitate the switching of the firearm 100 between different operating modes. In at least one embodiment, the safety mechanism 110 is switchable between at least two modes such as a normal firing mode and a safe mode. In safe mode, the firearm 100 is prevented from firing a round of ammunition. The safety mechanism 110 is in communication with the trigger mechanism 108. Further, in the depicted embodiment, the safety mechanism 110 is disposed on the left side of the lower receiver 102.

The bolt catch release mechanism 112 is configured to disengage a bolt catch (shown schematically in FIGS. 3-4) from impeding the movement of the bolt assembly within the upper receiver 104 of the firearm 100. The bolt catch is mounted within the lower receiver 102 and will be described in more detail with respect to FIGS. 3-4.

The magazine well 114 is configured to receive the ammunition loading device 118 or other similarly sized ammunition holders. The magazine well 114 offers a port for ammunition to be loaded into a firing chamber of the upper receiver 104. The ammunition loading device 118 can be an ammunition storage and feeding device within the firearm 100. In at least one embodiment, the ammunition loading device 118 is detachably installed to the firearm 100. For example, the ammunition loading device 118 is removably inserted into a magazine well 114 of the lower receiver 102 of the firearm 100. In the depicted embodiment, the ammunition loading device 118 is a single shot loading device as shown in FIGS. 3-4.

Other embodiments of the firearm 100 have other configurations than the examples illustrated and described with reference to FIGS. 1 and 2. For example, some of the components listed above are not included in some alternative embodiments.

Figure 3:
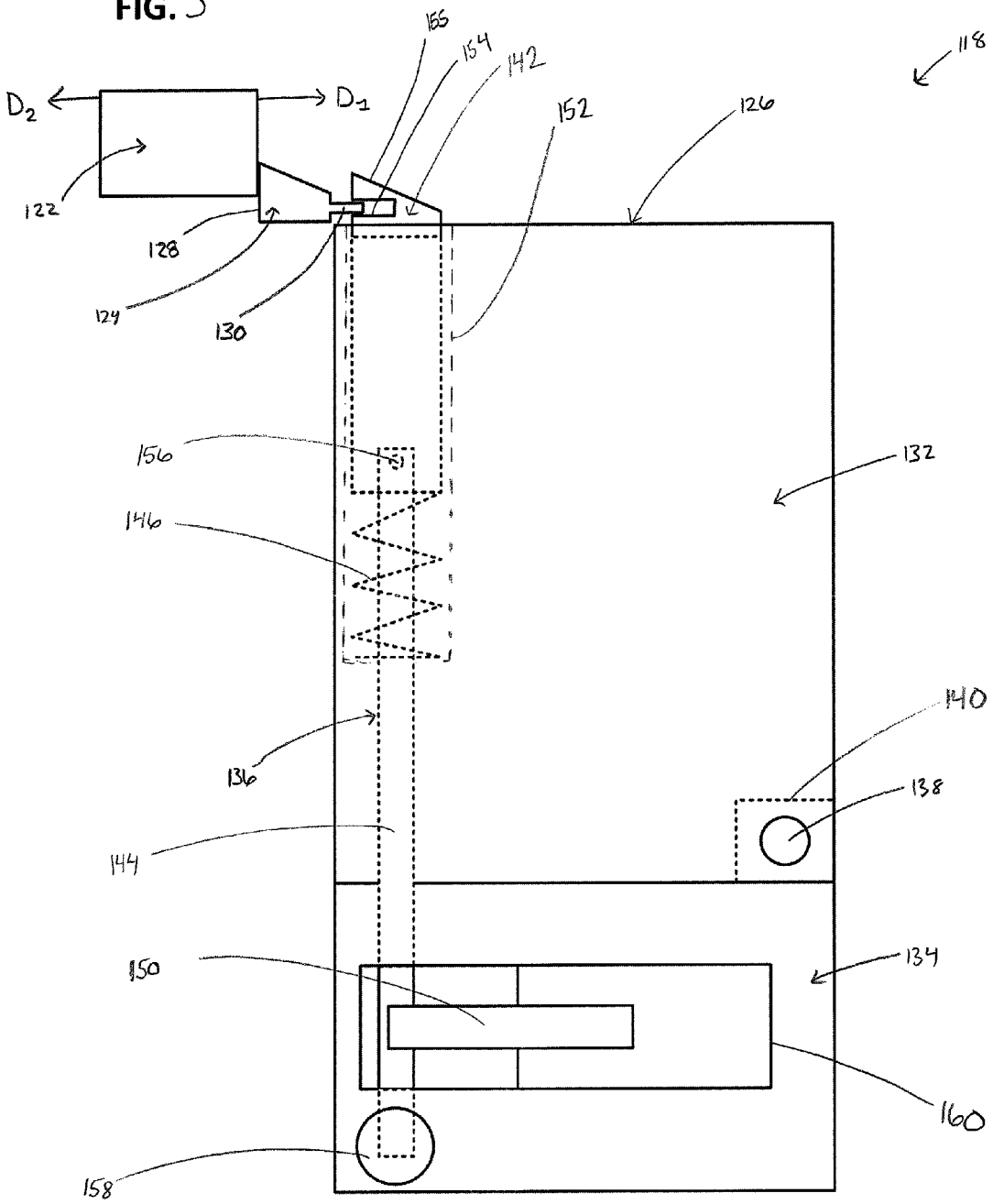
FIG. 3 illustrates a schematic side view of an ammunition loading device in a closed position, according to one embodiment of the present disclosure.
Figure 4:
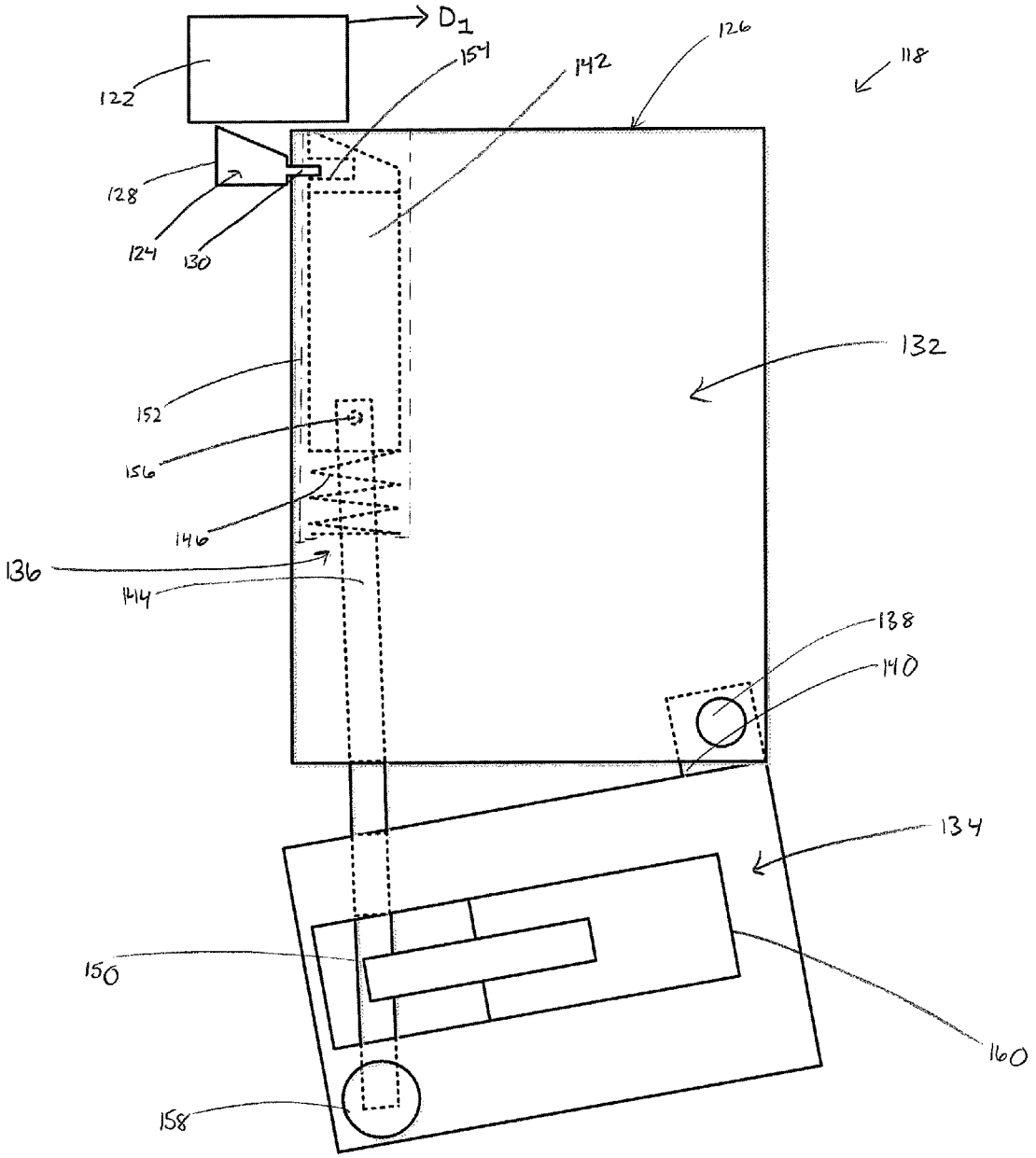
FIG. 4 illustrates a schematic side view of the ammunition loading device of FIG. 3 in an open position.

FIG. 3 shows a schematic right side view of the ammunition loading device 118 when positioned within the magazine well 114. Also schematically shown are a bolt assembly 122 and a bolt catch 124. The ammunition loading device 118 is configured to be removably inserted into the magazine well 114 of the firearm 100, as shown in FIG. 1. The ammunition loading device 118 is configured to allow only a single round of ammunition to be loaded within the firearm 100 at one time. The overall dimensions of the ammunition loading device 118 can vary depending on the size of the firearm, the size of the magazine well, and the caliber of the ammunition fired from the firearm. In some embodiments, the ammunition loading device 118 is configured to hold a .223 caliber cartridge. In other embodiments, the ammunition loading device 118 is configured to hold a .308 caliber cartridge. Also, the ammunition loading device 118 can be configured to hold a variety of other different caliber cartridges.

In some embodiments, the bolt assembly 122 includes a bolt carrier that houses a bolt (not shown). Also, in some embodiments, the bolt assembly 122 is configured to house a firing pin (not shown). During the firing cycle sequence of the firearm 100 to which the bolt assembly 122 is equipped, the bolt assembly 122 is configured to move in a direction $D_1$ toward the forward portion of the firearm 100 and in a direction $D_2$ toward the rearward portion (toward the stock 106) of the firearm 100 during a firing cycle. However, to impede the bolt assembly 122's movement, the bolt assembly 122's path of travel can be temporarily blocked by the bolt catch 124.

The bolt catch 124 is configured to selectively stop the movement of the bolt assembly 122. Specifically, the bolt catch 124 is configured to stop the movement of the bolt assembly 122 traveling in the direction $D_1$ before the bolt assembly 122 gets to the ammunition loading device 118. By doing this, the bolt assembly 122 is positioned to allow a round of ammunition to be loaded through the ejection port 120 (shown in FIG. 1) and on to a top cradle surface 126 of the ammunition loading device 118.

The bolt catch 124 is movable between a raised position (as shown in FIG. 3) and a lowered position (as shown in FIG. 4). In the depicted embodiment, the bolt catch 124 is movable from the raised position to the lowered position by the ammunition loading device 118. In some embodiments, the bolt catch 124 is movable from the raised position to the lowered position by pressing the bolt catch release mechanism 112 on the left side of the lower receiver 102 (shown in FIG. 2).

As shown, the bolt catch 124 includes a stop surface 128 and a lifting surface 130. The stop surface 128 is configured to interface with the bolt assembly 122 when the bolt catch 124 is in the raised position, as shown in FIG. 3. In the depicted embodiment, the lifting surface 130 is shown interfacing with the ammunition loading device 118.

The ammunition loading device 118 is shown to include an upper body portion 132, a lower body portion 134, and a lifter linkage 136. In the depicted embodiment, the upper body portion 132 and the lower body portion 134 are configured to move relative to one another to operate the lifter linkage 136. The lifter linkage 136 is configured to engage the bolt catch 124 so as to move the bolt catch 124 between the raised position and the lowered position.

The upper body portion 132 is configured to house at least a portion of the lifter linkage 136. Additionally, the upper body portion 132 includes the top cradle surface 126 that is configured to position a round of ammunition in a position so that, as the bolt assembly 122 moves in a direction $D_1$ after the bolt catch 124 is moved to the lowered position, the bolt assembly 122 moves the round of ammunition from the top cradle surface 126 into the firing chamber of the firearm 100. In some embodiments, the top cradle surface 126 can be at least partially recessed into the upper body portion 132 so as to position the round properly for the bolt assembly 122. In other embodiments, the top cradle surface 126 includes a groove (not shown) to position the round of ammunition on the top cradle surface 126.

The lower body portion 134 is shown attached to the upper body portion 132. In some embodiments, the lower body portion 134 is at least partially positioned outside of the magazine well 114 when the ammunition loading device 118, specifically the upper body portion 132, is positioned within the magazine well 114. The lower body portion 134 is movable with respect to the upper body portion 132. In some embodiments, the lower body portion 134 is slidably attached to the upper body portion 132. In the depicted embodiment, the lower body portion 134 is pivotally attached to upper body portion 132 and is rotatable about a pivot pin 138 between an open position (shown in FIG. 4) and a closed position (shown in FIG. 3). In the closed position, the lower body portion 134 is positioned directly adjacent to the upper body portion 132. In FIG. 3, the lower body portion 134 is seated against the upper body portion 132 when in the closed position.

The pivot pin 138 is shown fixed through the upper body portion 132 and through a pivot tab 140 of the lower body portion 134. The pivot tab 140 (shown exposed in FIG. 4) is configured to be positioned within the upper body portion 132 when the lower body portion 134 is in the closed position.

With continued reference to FIG. 3, the lifter linkage 136 is shown disposed between the upper body portion 132 and the lower body portion 134 of the ammunition loading device 118. The lifter linkage 136 includes a bolt catch lifter 142, a shaft 144, a spring 146, and an engagement bar 150. The lifter linkage 136 can be positioned within a bore 152 in the upper body portion 132. The lifter linkage 136 is configured to alter the position of the bolt catch 124 with the movement of the lower body portion 134 with respect to the upper body portion 132.

The bolt catch lifter 142 is configured to engage with the lifting surface 130 of the bolt catch 124. Specifically, the bolt catch lifter 142 includes a slot 154 that is configured to at least partially surround the lifting surface 130 of the bolt catch 124 so as to allow the bolt catch lifter 142 to alter the position of the bolt catch 124. The bolt catch lifter 142 is positioned within the bore 152 and the slot 154 and is configured to be positioned above the top cradle surface 126 when the lower body portion 134 is in the closed position and the bolt catch 124 is in the raised position (as shown in FIG. 3). Additionally, the bolt catch lifter 142 includes a ramped back surface 155. The ramped back surface 155 allows the bolt assembly 122 to travel over the bolt catch lifter 142 when moving in the direction $D_2$ after a round is fired from the firearm 100. Further, the bolt catch lifter 142 is connected to the shaft 144 by a link pin 156.

The shaft 144 is configured to connect the bolt catch lifter 142 with the lower body portion 134 of the ammunition loading device 118. The shaft 144 is movable with respect to the bolt catch lifter 142 and configured to rotate about the link pin 156 upon movement of the lower body portion 134 between the closed position and the open position. In some embodiments, the shaft 144 is retained in the lower body portion 134 by a nut 158.

The spring 146 is positioned within the bore 152, below the bolt catch lifter 142. The spring 146 is configured to hold the lifter linkage 136, and specifically the bolt catch lifter 142, in a lifted position when the lower body portion 134 is in a closed position. The spring 146 prevents the bolt catch lifter 142 from hitting the lower portion of the bore 152 due to gravity when the lower body portion 134 is in the closed position.

The engagement bar 150 is attached to the shaft 144 and allows for simplified rotation of the of the lifter linkage 136. The engagement bar 150 is shown positioned within a cut-out window 160 that passes through the lower body portion 134 to ease operation thereof. By rotating the engagement bar 150 in a direction away from the lower body portion 134, the bolt catch lifter 142, and specifically the slot 154, are also rotated. Such rotation allows for the disengagement of the lifter linkage 136, specifically the bolt catch lifter 142, from the bolt catch 124. Once disengaged, the ammunition loading device 118 can be removed from the magazine well 114. Conversely, when inserting the ammunition loading device 118 into the magazine well 114, the engagement bar 150 is rotated toward the lower body portion 134 to engage the lifter linkage 136 with the bolt catch 124.

FIG. 4 shows the ammunition loading device 118 when the lower body portion 134 is in the open position. As shown, the bolt assembly 122 is moving in a direction $D_1$ toward the front of the firearm 100 and over the top cradle surface 126 of the ammunition loading device 118. Additionally, the bolt catch 124 is shown in the lowered position.

As the lower body portion 134 is moved from the closed position to the open position, the shaft 144 of the lifter linkage 136 is pulled in a downward direction, away from the bolt assembly 122. As the shaft 144 is moved downward, the shaft 144 pulls the bolt catch lifter 142 in a downward direction within the bore 152 of the upper body portion 132. In the depicted embodiment, because the lower body portion 134 is rotated and the shaft 144 is retained to the lower body portion 134, the shaft 144 rotates about the link pin 156. As the shaft 144 and bolt catch lifter 142 are moved downward, the spring 146 is compressed with the bore 152. Additionally, because the bolt catch lifter 142 is engaged with the bolt catch 124, the bolt catch 124 is also moved from a raised position to a lowered position as the lower body portion 134 is rotated. Once the bolt catch 124 is in the lowered position, the bolt assembly 122 can pass over the ammunition loading device 118. Due to the spring tension in the spring 146, once the force that caused the rotation of the lower body portion 134 is released from the lower body portion 134, the spring 146 will force the lower body portion 134 back from the open position to the closed position, thereby raising the bolt catch 124 to the raised position. This allows ammunition loading device 118 to position the bolt assembly 122 at the rear of the firearm 100 by raising the bolt catch 124 after each round of ammunition is fired.

To operate the firearm 100 equipped with the ammunition loading device 118, the shooter can proceed similar to the following. The shooter can first lock the bolt assembly 122 to the rear of the firearm 100. The ammunition loading device 118 is then loaded into the magazine well 114 with the engagement bar 150 of the lifter linkage 136 positioned outside the window 160 of the lower body portion 134 of the ammunition loading device 118. Once inserted into the magazine well 114, the engagement bar 150 is rotated so as to be positioned within the window 160 of the lower body portion 134 to engage the lifter linkage 136 with the bolt catch 124 of the firearm 100. A round of ammunition is then inserted through the ejection port 120 so as to be positioned on the top cradle surface 126 of the ammunition loading device 118. Once a round of ammunition is inserted, the lower body portion 134 is rotated by the shooter from the closed position to the open position. Such rotation causes the bolt assembly 122 to move over the ammunition loading device 118 and load the round of ammunition into the firing chamber. Due to the force exerted by spring 146, the lower body portion 134 will return to the closed position once the lower body portion 134 is released by the shooter. The shooter is then free to fire the round of ammunition from the firearm 100. Immediately after the round is fired, the bolt assembly 122 will travel in the direction $D_2$ toward the rear of the firearm 100 over the ammunition loading device 118, specifically over the bolt catch lifter 142 and the bolt catch 124. Once at the rear of the firearm 100, the bolt assembly 122 will begin traveling in the direction $D_1$ toward the front of the firearm 100 until the bolt assembly 122 interfaces with the stop surface 128 of the bolt catch 124. At such a time, the bolt assembly 122 will cease movement, and the shooter can insert another round into the ejection port 120 for additional firing.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

What is claimed is:

1. An ammunition loading device for a firearm comprising;

a first body portion configured to be positioned within a magazine well of the firearm;

a second body portion pivotable about the first portion;

a linkage disposed between the first body portion and the second body portion, the linkage having a bolt catch lifter movable between at least a raised position and a lowered position;

wherein, when in the raised position, the bolt catch lifter holds a bolt catch of the firearm in a raised position and, when moving from the raised position to the lowered position, the bolt catch lifter lowers the bolt catch of the firearm to a lowered position.

2. The ammunition loading device of claim 1, wherein the body includes a cradle at a top surface for holding a single round of ammunition.

* * * * *